US005339894A

United States Patent [19]

Stotler

[11] Patent Number: 5,339,894

[45] Date of Patent: Aug. 23, 1994

[54] RUBBER SEAL ADAPTOR

[76] Inventor: William R. Stotler, 2520 Corto St., Bakersfield, Calif. 93306

[21] Appl. No.: 862,637

[22] Filed: Apr. 1, 1992

[51] Int. Cl.[5] ..... E21B 33/128

[52] U.S. Cl. ..... 166/182; 166/196; 166/237; 403/105

[58] Field of Search ..... 166/182, 196, 237, 134; 403/105, 109

[56] References Cited

U.S. PATENT DOCUMENTS

| | | | |
|---|---|---|---|
| 2,228,244 | 1/1941 | Baker | 166/237 X |
| 2,365,052 | 12/1944 | Chamberlain | 166/237 |
| 2,388,056 | 10/1945 | Hendricks | 403/105 |
| 2,770,155 | 11/1956 | Morgan | 403/105 X |
| 2,878,876 | 3/1959 | Long | 166/196 |
| 3,306,362 | 2/1967 | Urbanosky | 166/237 X |

*Primary Examiner*—Hoang C. Dang

[57] ABSTRACT

A rubber seal adaptor for a well having a pipe fitting, a compression sleeve about the pipe fitting and rubber seal rings positioned about the pipe fitting so as to be compressed by the compression sleeve. A first circular groove in the bore of the compression sleeve has a conical surface such that there is a shallower portion and a deeper portion. A plurality of circular grooves extend about the periphery of the pipe fitting so as to be adjacent the groove in the compression sleeve. A plurality of steel balls are positioned within the groove in the compression sleeve to interfere with the plurality of grooves for locking the compression sleeve in a compressed condition against the rubber seal rings. The pipe fitting includes threaded ends for receiving a kelly nut and a liner.

7 Claims, 3 Drawing Sheets

RUBBER SEAL ADAPTOR

BACKGROUND OF THE INVENTION

The field of the present invention is hardware floor wells.

Wells and particularly oil wells include casings through which perforations are made to allow liquid or gaseous flow into the well from selected strata. Such perforations may be made at various levels within the well for a variety of reasons. At times, however, it has been found advantageous to close off certain perforations within the well. For example, in oil production, due to water flood or steaming activities or simply due to natural causes, perforations at a specific level in the well may be producing excessive water. Perforations at another level may continue to produce oil. Consequently, it is advantageous to close off the perforations producing water. However, as the perforations are displaced from easy reach, a variety of techniques have been employed with varying success and cost.

The most common approach to isolating unwanted casing perforations is to fill the well bore with sand until the unwanted perforations are covered. This sand plug is then capped with a small cement plug to complete the isolation and prevent accidental removal or "bailing" of the sand plug. This method has the advantage of not being a permanent plug as well as being the least expensive. However, such cement caps are often unconsolidated, causing unintentional removal during regular well maintenance work, as well as not effectively isolating the unwanted lower set of perforations. Also the unwanted perforations may be very close to perforations which are to be left unplugged. Such a situation makes placement of the cement cap difficult and the use of this technique has caused desired perforations to be contaminated with cement which can cause a drop in well production. Also under such a circumstance, the rathole available may be reduced to the point that the down hole pump cannot be placed below all perforations and the well work necessary to keep fill from covering perforations is increased significantly.

A second method also widely used to isolate unwanted perforations is to squeeze the perforations with cement. After the perforations have been plugged, the well board is cleaned out which alleviates the problems associated with reducing the rathole. This method has the advantage of allowing perforations to be plugged while leaving perforations both above and below open for production. However, this is a significantly more expensive process than using a cement cap plug on sand. In certain formations, the method is difficult to apply because the formation sands are unconsolidated and have very high permeability. Experience has shown that significant volumes of cement can be pumped without shutting off the perforations. This further increases the cost of this method. Further, the effectiveness of these squeezes is questionable. Difficulties in placing cement in every perforation and the breakdown of the squeeze perforations has caused operating problems and the return to a situation where the perforations were not isolated. Under conditions where high volumes of cement are required to provide this type of plug, it must be considered a permanent abandonment of the zone for that well. Finally, operational problems also occur when the perforated interval to be squeezed is close to an interval to be left open. Also, a significant number of packers have been cemented in place, further contributing to average cost per plug.

Additional alternatives for isolating perforations include casing patches and liner hanger-packers. Both of these methods are prohibitively expensive. Casing patches present a permanent reduction of well bore diameter limiting the use of additional liners at a later time. Further, liner hanger-packers are not designed to be retrieved, making this method semi-permanent.

Rubber seal adapters have been designed which employ a pipe fitting with an annular flange about the periphery thereof. The fitting has external threads at one end to be associated with a liner and internal threads at the other to be associated with a kelly nut. A compression sleeve slidably extends over the pipe fitting. One or more rubber seal rings are positioned between the annular flange and the compression sleeve to be compressed outwardly against the surrounding casing or liner for the isolation of perforations. Floating retainer rings between adjacent rubber seal rings with the annular flange, the floating rings and the compressent ring have undercut portions to receive and retain the rubber seal rings. Such a device is inexpensive to produce and can be retrieved from a well. A positive seal is created and the rathole remains, optimizing pump placement and reducing well work frequency. The effectiveness of the seal is easily tested and should not change with time. The adaptor can be placed very accurately and there is no destruction or contamination of the perforations being plugged. The adaptor is durable, allowing well work without risking damage to the seal. However, the adaptor cannot support tension or compression, consequently the liner must be set on the bottom. This limits the application of such adapters to only those perforations that are below all other perforated intervals. Also, only load pressure differentials are believed to be tolerated.

SUMMARY OF THE INVENTION

The present invention is directed to a lock for a rubber seal adaptor to retain the compression sleeve fixed on the pipe fitting with the rubber seal ring or rings in compression. To this end, a lock is provided in a rubber seal adaptor employing a plurality of grooves in one of the exterior of the pipe fitting or the interior of the compression sleeve. In the other element, a groove is arranged which has a shallower portion and a deeper portion. Hard elements are positioned in the latter groove such that they interfere with the plurality of grooves when in the shallow portion and are clear of the plurality of grooves when in the deeper portion. In this way, compression may be maintained by the compression sleeve against rubber seal rings positioned about an associated pipe fitting.

Accordingly, it is an object of the present invention to provide an improved rubber seal adaptor for wells. Other and further objects and advantages will appear hereinafter.

DETAILED DESCRIPTION OF THE PREFERRED EMBODIMENT

Figure 1:
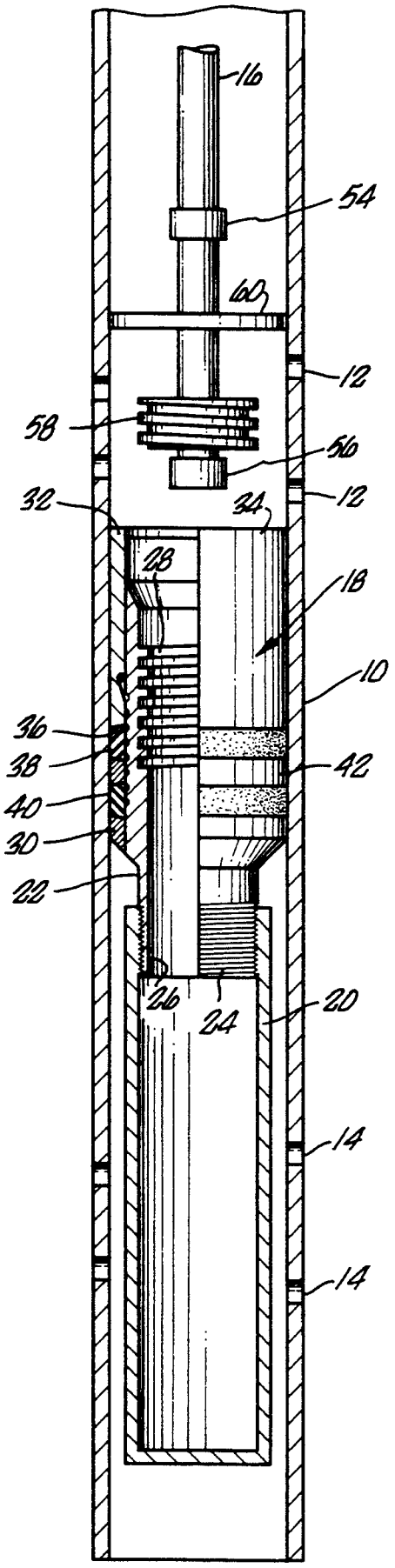
FIG. 1 illustrates a well containing an adaptor of the present invention shown in vertical cross section.

Turning in detail to the drawings, a well is illustrated in FIG. 1 including a casing 10 having a first set of perforations 12 and a second set of perforations 14. A kelly bar 16 is shown extending into the well. Positioned to seal off the perforations 14 is a rubber seal adaptor, generally designated 18. The rubber seal adaptor 18 is coupled with a liner 20 which extends to the bottom of the well. As the rubber seal adaptor results in sealing above the perforations 14, these perforations are isolated from the well until removal of the adaptor.

Figure 2:
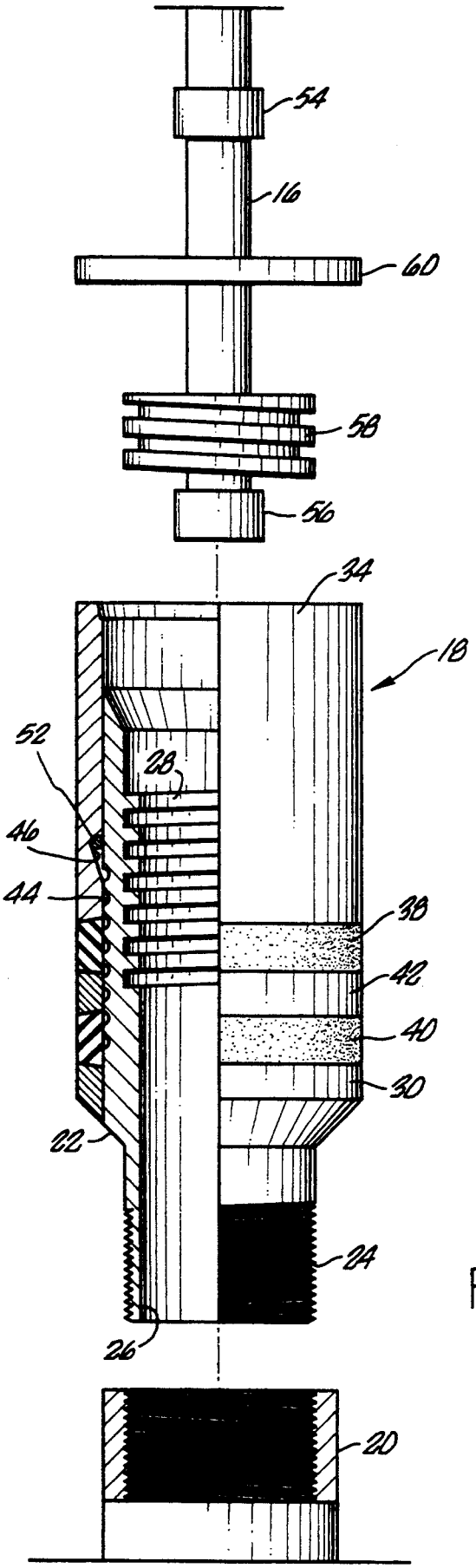
FIG. 2 is an exploded view of an adaptor of the present invention in partial cross section associated with a liner and a kelly bar tool.

Looking in greater detail to the adaptor 18, reference is made to FIG. 2. A pipe fitting 22 is shown to include an external thread 24 at one end thereof. This external thread 24 is contemplated to be a Ventura flush joint thread or as otherwise specified to mate with the liner 20. In the interior bore 26 of the pipe fitting 22, internal threads 28 are formed in the sidewall. These threads 28 are preferably left hand kelly nut threads. Located on the exterior of the pipe fitting 22 is an annular flange 30 welded thereto.

Positioned on and slidably over the pipe fitting 22 is a compression sleeve 32. The compression sleeve 32 is cylindrical with a flat end 34 to receive a compression force thereon and an undercut end 36.

Positioned on the periphery of the pipe fitting 22 between the flange 30 and the compression sleeve 32 are two rubber seal rings 38 and 40 and one hard floating retainer ring 42 therebetween. The flange 30, the undercut end 36 and the floating retainer ring 42 have undercut portions so as to receive the rubber seal rings 38 and 40 to retain them therein under compressive load.

Figure 3:
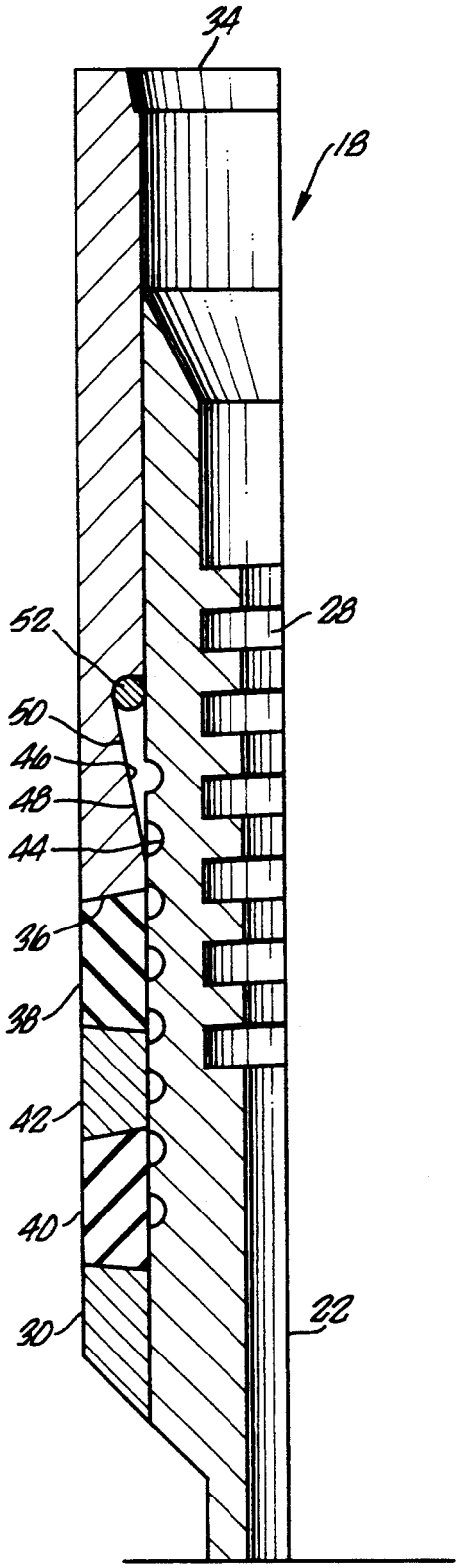
FIG. 3 is a detailed vertical cross section illustrating an unlocked association between a pipe fitting and a compression sleeve.
Figure 4:
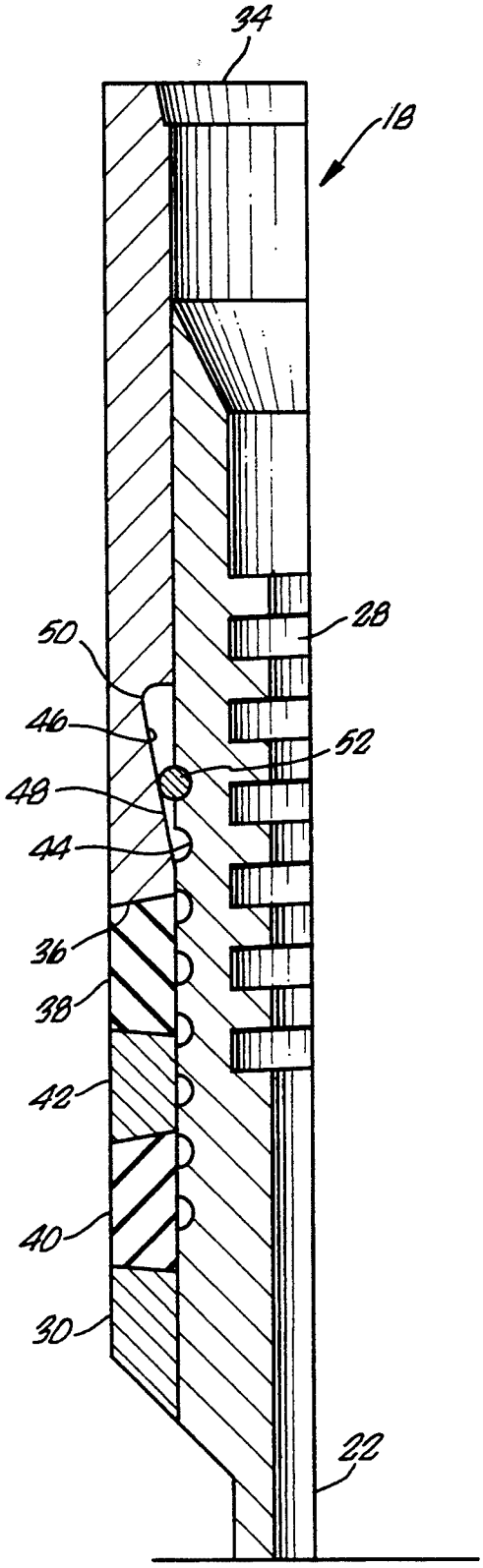
FIG. 4 is a detailed vertical cross section illustrating a locked association between a pipe fitting and a compression sleeve.

Looking in yet further detail, reference is made to FIGS. 3 and 4 where a locking mechanism is best illustrated. Located in the pipe fitting 22 is the plurality of circular grooves 44 of substantially uniform depth. The circular grooves 44 are conveniently semi-circular in cross section. Located in the bore of the compression sleeve 32 is a circular groove 46. The circular groove 46 has a conical surface defining same such that, as viewed in cross section, there is a shallower portion 48 and a deeper portion 50. These portions, albeit separately defined, may simply be a continuous surface. Located within the circular groove 46 are a plurality of hard elements. In the preferred embodiment, these elements are steel balls 52. The balls 52, the circular groove 46 and the plurality of circular grooves 44 are arranged such that the balls 52 setting in the deeper portion 50 of the circular groove 46 do not interfere with the pipe fitting 22 and specifically the plurality of circular grooves 44. At the same time, balls 52 positioned at the shallower portion 48 of the circular groove 46 will closely fit within one of the plurality of circular grooves 44. The former, unlocked condition is illustrated in FIG. 3 while the latter, locked condition is illustrated in FIG. 4. As can be understood from a view of these figures, the locking mechanism prevents the compression sleeve from backing off the rubber seal rings 38 and 40.

In operation, a kelly tool including a square kelly bar 16 with fixed collars 54 and 56 includes a kelly nut 58 and a compression ring 60. The kelly nut 58 and the compression ring 60 actually float on the kelly bar 16 but are constrained to rotate therewith. The kelly nut 58 includes kelly nut threads which are capable of mating with the internal threads 28 of the pipe fitting. External to the well, the rubber seal adaptor 18 is coupled with the kelly bar 16 by locating the kelly nut 58 in threaded relationship with the internal threads 28 of the pipe fitting 22. A liner 20 is also coupled with the pipe fitting 22 using the external threads 24. The assembly is then lowered into the well to the proper position.

Once positioned, the string including the kelly bar 16 is allowed to rest on the ring 60 which in turn rest on the flat end 34 of the compression sleeve 32. This in turn compresses the rubber seal rings 38 and 40 against the casing 10. As the rubber seal adaptor 18 is oriented in a substantially vertical position, the balls 52 fall toward the shallower portion 48 of the circular groove 46 and in turn into one of the plurality of circular grooves 44. The kelly nut 58 may be unscrewed from the pipe fitting 22 either before or after compression of the rubber seal rings 38 and 40. The kelly tool then may be withdrawn for replacement of any pumping mechanism in the well. With the rubber seal rings in resilient compression, the balls 52 are retained to maintain the locked condition. In this way, an effective seal is formed against the casing 10 or any liner which may already be positioned within the well.

Accordingly, a rubber seal adaptor is provided with a locking mechanism effecting a permanent locking of such an adaptor ring within the well. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A rubber seal adaptor for a well, comprising a pipe fitting having a first end with an exterior thread, a second end with an interior thread, a first bore therethrough from said first end to said second end and an annular flange about the periphery thereof;

a compression sleeve having a second bore therethrough slidable extending over said pipe fitting;

a rubber seal ring positioned between said annular flange and said compression sleeve;

a first circular groove in one of said second bore of said compression sleeve or the periphery of said pipe fitting with a first, shallower portion and a second, deeper portion;

a plurality of adjacent second circular grooves in the other of said second bore of said compression sleeve or the periphery of said pipe fitting of substantially equal depth;

a plurality of hard elements positioned in said first circular groove, said elements fitting closely within a said second circular groove and said shallower portion of said first circular groove to retain said compression sleeve from sliding on said pipe fitting and fitting within said deeper portion without extending into a said second circular groove to allow sliding of said compression sleeve on said pipe fitting.

2. The rubber seal adaptor of claim 1 further comprising a second rubber seal ring positioned between said annular flange and said compression sleeve and a floating retainer ring between said first rubber seal ring and said second rubber seal ring, said first rubber seal ring, said second rubber seal ring and said floating retainer ring all being between said annular flange and said compression sleeve.

3. The rubber seal adaptor of claim 1 wherein said first circular groove has a conical surface to define said deeper and shallower portions.

4. The rubber seal adaptor of claim 1 wherein said hard elements are metal balls.

5. The rubber seal adaptor of claim 1 wherein said first circular groove is in said bore of said compression sleeve and said second circular grooves are in said pipe fitting.

6. The rubber seal adaptor of claim 5 wherein said deeper portion is toward said second end from said shallower portion.

7. A rubber seal adapter for a well, comprising a pipe fitting having a first end with an exterior thread, a second end with an interior thread, a first bore therethrough from said first end to said second end and an annular flange about the periphery thereof;

a compression sleeve having a second bore therethrough slidably extending over said pipe fitting;

a rubber seal ring positioned between said annular flange and said compression sleeve;

a first circular groove in said second bore of said compression sleeve with a first, shallower portion and a second, deeper portion, said first circular groove having a conical surface to define said deeper and said shallower portions, said deeper portion being toward said second end from said shallower portion;

a plurality of adjacent second circular grooves in the periphery of said pipe fitting of substantially equal depth;

a plurality of metal balls positioned in said first circular groove, said metal balls fitting closely within a said second circular groove and said shallower portion of said first circular groove to retain said compression sleeve from sliding on said pipe fitting and fitting within said deeper portion without extending into a said second circular groove to allow sliding of said compression sleeve on said pipe fitting;

a second rubber seal ring positioned between said annular flange and said compression sleeve;

a floating retainer ring between said first rubber seal ring and said second rubber seal ring, said first rubber seal ring, said second rubber seal ring and said floating retainer ring all being between said annular flange and said compression sleeve.

* * * * *